US007971401B2

(12) United States Patent
Preiss

(10) Patent No.: US 7,971,401 B2
(45) Date of Patent: Jul. 5, 2011

(54) CONSTRUCTION MODULE

(76) Inventor: Hermann Preiss, Untergruppenbach (DE)

( * ) Notice: Subject to any disclaimer, the term of this patent is extended or adjusted under 35 U.S.C. 154(b) by 988 days.

(21) Appl. No.: 11/661,848

(22) PCT Filed: Sep. 6, 2005

(86) PCT No.: PCT/EP2005/054390

§ 371 (c)(1),
(2), (4) Date: Mar. 5, 2007

(87) PCT Pub. No.: WO2006/027357

PCT Pub. Date: Mar. 16, 2006

(65) Prior Publication Data

US 2008/0034706 A1 Feb. 14, 2008

(30) Foreign Application Priority Data

Sep. 6, 2004 (DE) ..... 20 2004 014 003 U

(51) Int. Cl.
*E04C 3/02* (2006.01)

(52) U.S. Cl. ..... 52/204.2; 52/167.3; 52/293.3

(58) Field of Classification Search ..... 52/204.2, 52/167.3, 293.3, 474, 478, 481.1, 592.1
See application file for complete search history.

(56) References Cited

U.S. PATENT DOCUMENTS

| | | | | |
|---|---|---|---|---|
| 2,553,227 | A * | 5/1951 | Wesner | 52/376 |
| 3,040,388 | A * | 6/1962 | Conn | 52/127.12 |
| 3,186,130 | A * | 6/1965 | Gray | 52/416 |
| 3,236,014 | A * | 2/1966 | Edgar | 52/270 |
| 3,292,321 | A * | 12/1966 | Vander Schans | 52/243.1 |
| 3,488,904 | A * | 1/1970 | Dawdy et al. | 52/241 |
| 4,164,832 | A * | 8/1979 | Van Zandt | 52/592.1 |
| 4,694,624 | A * | 9/1987 | Juhas | 52/223.7 |
| 7,127,856 | B2 * | 10/2006 | Hagen et al. | 52/309.9 |

FOREIGN PATENT DOCUMENTS

| | | | |
|---|---|---|---|
| DE | 296 14 258 | U1 | 9/1997 |
| DE | 197 09 661 | A | 4/1998 |
| EP | 0 744 507 | A | 11/1996 |
| EP | 0 744 507 | B1 | 7/2001 |
| EP | 0 894 170 | B1 | 8/2001 |
| FR | 2 659 370 | A | 9/1991 |
| WO | WO 01/59228 | A | 8/2001 |

* cited by examiner

*Primary Examiner* — Basil Katcheves

(74) *Attorney, Agent, or Firm* — Collard & Roe, P.C.

(57) ABSTRACT

The invention relates to a construction module for erecting flat structures, particularly walls, comprising two parallel panel-shaped wall parts and a module core arranged between them. According to the invention, each wall part has a number of room-height solid squared timbers that are set on end. These squared timbers are joined to one another in an at least non-positive manner via a mechanical pinning placed transversal to the longitudinal direction of the squared timbers and extending in the plane of the wall parts, and/or these squared timbers are each pinned in an at least non-positive manner with at least two crossbars, which extend essentially transversal to the longitudinal direction of the squared timbers and which are located in the future module core.

18 Claims, 4 Drawing Sheets

CONSTRUCTION MODULE

CROSS REFERENCE TO RELATED APPLICATIONS

Figure 1:
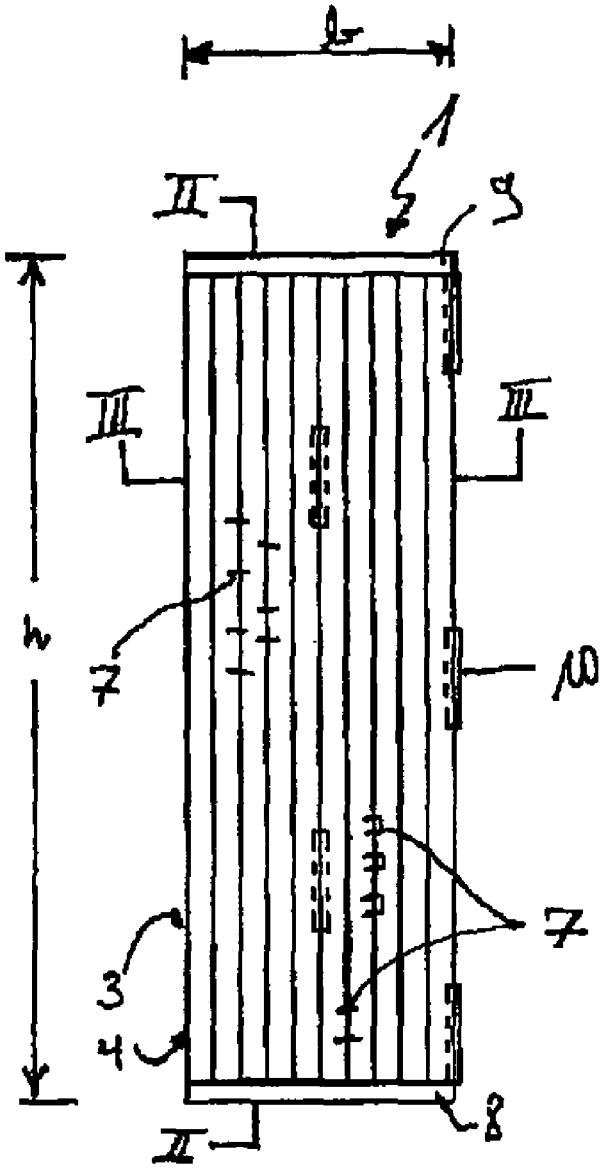

Applicant claims priority under 35 U.S.C. §119 of German Application No. 20 2004 014 003.9 filed Sep. 6, 2004. Applicant also claims priority under 35 U.S.C. §365 of PCT/EP2005/054390 filed Sep. 6, 2005. The international application under PCT article 21(2) was not published in English.

The invention relates to a construction module for the building of planar structures, in particular for walls, ceilings and roofs, according to the preamble to claim 1.

From EP 0 894 170 B1, a construction module for the building of planar structures, in particular walls, is known, having two parallel, plate-shaped wall sections, whose outer faces facing away from each other are designed to form a part of the surfaces of the wall to be built. Between the two wall sections there is disposed a module core composed of a plurality of individually produced and interconnected parts and fixedly connected, in particular glued, to the wall sections. The module core has at least one module core part extending in the longitudinal direction of the construction module, which is designed to jut in between the wall sections of a further construction module and, by bearing against an inner face of these wall sections, to form a plug joint which absorbs the forces in the transverse direction. In addition, the module core is provided with means which are designed to form with the module core of a further construction module a plug joint which absorbs the forces in the longitudinal direction.

From EP 0 744 507 B1, a further construction module for the building of planar structures is known, having two parallel plates which are connected to one another by a plurality of intermediate elements spaced apart in the longitudinal direction of the construction module and disposed parallel to one another. The construction module is composed of individual elements, such as the plates and the intermediate elements, the intermediate elements having on one side of the construction module projections jutting over the height of the plates. On the other side of the construction part, the intermediate elements are set back relative to the height of the plates, forming recesses, so that, if two construction modules are placed one on top of the other, the projections of the one construction module jut in between the plates into the recesses of the other construction module and, by bearing against the inner sides of the plates, directly form a gravity locking plug joint. A load-bearing and room-closing structure can consequently be built, in which no additional connecting means for the absorption of transverse forces are necessary. Here too, the planar structure is formed from a plurality of construction modules disposed one above the other and side by side.

The present invention tackles the problem of defining for a construction module of the type mentioned in the introduction an improved embodiment which, on the one hand, allows a simple and rapid building of planar structures, e.g. walls, and, on the other hand, fulfills individual supplementary functions, e.g. sound and/or heat insulation.

According to the invention, this problem is solved by the subject of the independent claim. Advantageous embodiments are the subject of the dependent claims.

The invention is based on the general concept, in a construction module having at least two parallel, plate-shaped wall sections and module cores disposed respectively between two wall sections, of forming each of the wall sections from a plurality of room-high solid squared timbers, set on edge, which are gluelessly connected to one another, at least non-positively, by a mechanical pinning disposed transversely to the longitudinal direction of the squared timbers and extending in the plane of the wall sections, and/or which are respectively pinned, at least non-positively, to at least two cross-ties extending substantially transversely to the longitudinal direction of the squared timbers and situated in the future module core. Basically, the squared timbers of the wall sections can be connected to one another in any chosen manner, for example by ultrasound welding or the like.

By virtue of the solution according to the invention, construction modules are thus created which can be preplanned, precalculated and prefabricated on a computer by means of CAD, whereby the actual construction time of a future building can be markedly reduced. At the same time, both load-bearing and non-load-bearing single-shell or multi-shell construction modules can be produced, which, furthermore, can be individually adapted to a wide variety of requirements, for example with respect to sound and/or heat insulation and fire protection. The dimensions of the construction modules are here preferably chosen such that, at least for one to two men, a simple handling and thus a simple building of the walls by self-construction methods is possible. Larger construction modules, with which whole walls can be produced in full, are also conceivable, however. The use of the construction modules according to the invention extends in this case from single and multi-family houses, via industrial and administrative buildings, through to special buildings, schools, nurseries, sports buildings and agricultural buildings. As a result of the sole use of solid timbers in the building of the construction modules, a particularly ecological, durable and sound construction can be obtained, whereby competitive advantages can be obtained, especially in the event of heavily increased environmental and health awareness.

Expediently, the module core is configured substantially hollow and for the reception of supply lines and/or insulating materials and/or bulk materials. In the simplest case, the construction module can here be built without the module core being filled with insulating materials and/or bulk materials, in which case the air left in the module core acts as an insulator. Of particular advantage in the construction module according to the invention is that all the supply lines, e.g. electric cables and/or water/waste water pipes, can be disposed in the module core and are hence laid such that they are not visible from the outside. If the module core is filled with bulk materials, e.g. glue, or insulating materials, e.g. mineral fibers, the two wall sections of each construction module serve as permanent shuttering. By lining the module core with concrete, it is possible, moreover, to significantly enhance the static structural effect of the wall, as well as to improve the heat-storage capability and the insulating effect against sound, heat and fire. The mechanical pinning between the individual squared timbers, which pinning runs in the plane of the wall, produces a diaphragm-like structural effect of each wall section and gives the construction module a particularly high load-bearing capacity and stability.

According to a preferred embodiment of the solution according to the invention, the construction module and/or the module core is/are closed off on the floor side by a single-part or multipart sill. In addition, the construction module and/or the module core can be closed off on the ceiling side by a single-part or multipart binder. The floor-side closure of the construction module and of the module core allows the hollow module core to be filled with non-fluid insulating materials already in the prefabrication stage, so that the construction module, together with filled module core, can be delivered and installed on the construction site. The high degree of prefabricability, in particular, is highly beneficial in this context, since process-dictated delays on the construction site can thereby be avoided.

Expediently, the squared timbers run unjointed over the full height of the module. As a result, an undisturbed force flow from the ceiling side to the floor side of the construction module is ensured and, moreover, a visual impression is positively influenced, which, in the case of jointed squared timbers, would be impaired by the end-face joints which then come about.

In a further preferred embodiment, spacing timbers are disposed between the wall sections, at least one spacing timber on a lateral longitudinal side of the wall section projecting beyond the latter, while on the opposite side the it is set back into the module core, so that two mutually adjacent construction modules interlock in the manner of a tongue and groove joint. The spacing timbers hold the two wall sections at a distance apart and, according to the chosen width of the same, influence a thickness of the module core situated between the two wall sections. The edge-side arrangement of the spacing timbers such that a type of tongue and groove connection is formed between two construction modules simplifies the fitting together of a plurality of construction modules and facilitates the building of a planar structure having a flush wall surface.

Expediently, in the construction module there is provided a door or window lintel, extending transversely to the square timbers, which runs in the module core and is pinned to the wall sections. This shows that the construction module according to the invention can be designed both as a closed (without windows and doors) and as a continuous construction module (with windows and doors), the arrangement of the door or window lintel being able to be realized individually, thereby allowing a broad degree of planning flexibility. At the same time, because of the almost freely selectable dimensions of the squared timbers, a very fine sizing of the construction modules with respect to length and width is possible.

In a further advantageous embodiment of the solution according to the invention, the wall sections, at least on an outer side, are faced, in particular plastered. Here, a heat-insulating plaster, for example, can be applied, with an intermediate barrier layer, for example a windpaper, which, though vapor-permeable, is not water-permeable or wind-permeable. In a plastered construction module, no difference relative to a traditional wall built in solid construction is outwardly discernible, so that the construction module according to the invention may also appear of interest to value-conservative developers. Of course, the construction module can also be externally and internally used with untreated wall section surface, whereby a particularly natural and warm living sensation is created. The squared timbers, depending on the desired surface for these, can either be saw-rough, leveled or planed, whereby respectively different wall surfaces are formed and whereby a wide variety of visual characteristics from rustic through to refined can be obtained.

Expediently, the construction modules have a height of 260 cm, a width of 80 cm and a thickness of up to 16 cm. These dimensions allow one to two workers to move and use the construction modules readily on the construction site without the need for heavy lifting gear, e.g. cranes. In order to facilitate the work, suitable lifting equipment can, of course, be used, whereby the building of the planar structure is further accelerated. Construction modules having the dimensions of a complete wall and/or having a room height of up to 5 m are also conceivable, however, which facilitates use, in particular, in industrial construction.

Further important features and advantages of the invention emerge from the subclaims, from the drawings and from the associated figure description with reference to the drawings.

Naturally, the abovementioned features and those which are yet to be described below can be used not only in the respectively stated combination, but also in other combinations or in isolation, without departing from the scope of the present invention.

Preferred illustrative embodiments of the invention are represented in the drawings and are explained in greater detail in the following description, the same reference symbols referring to the same or functionally identical or similar components.

Figure 2:
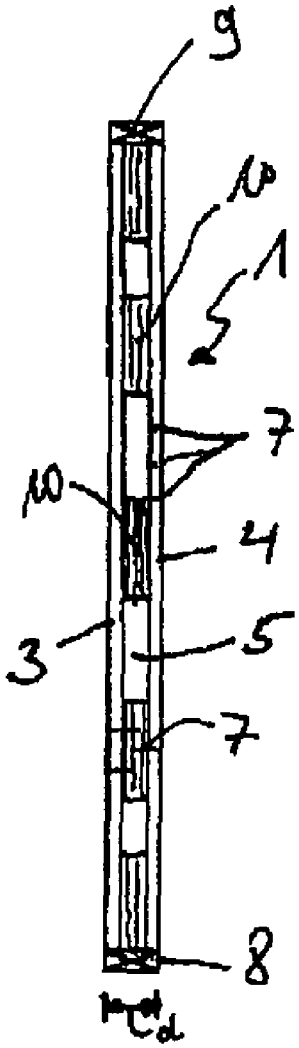
Figure 3:
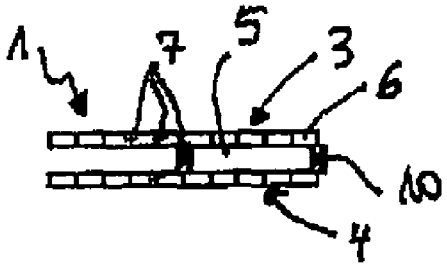
Figure 4:
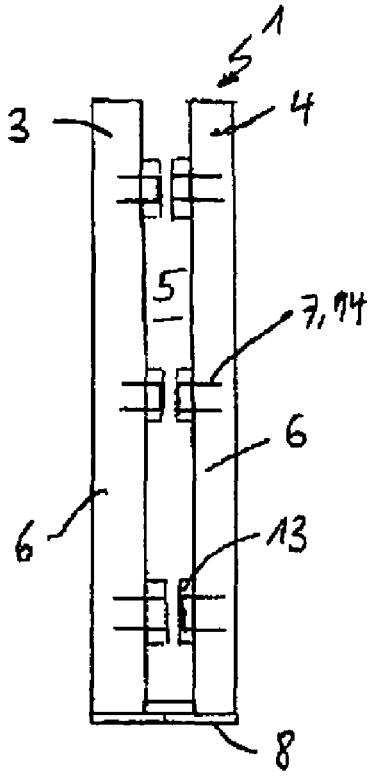
Figure 5:
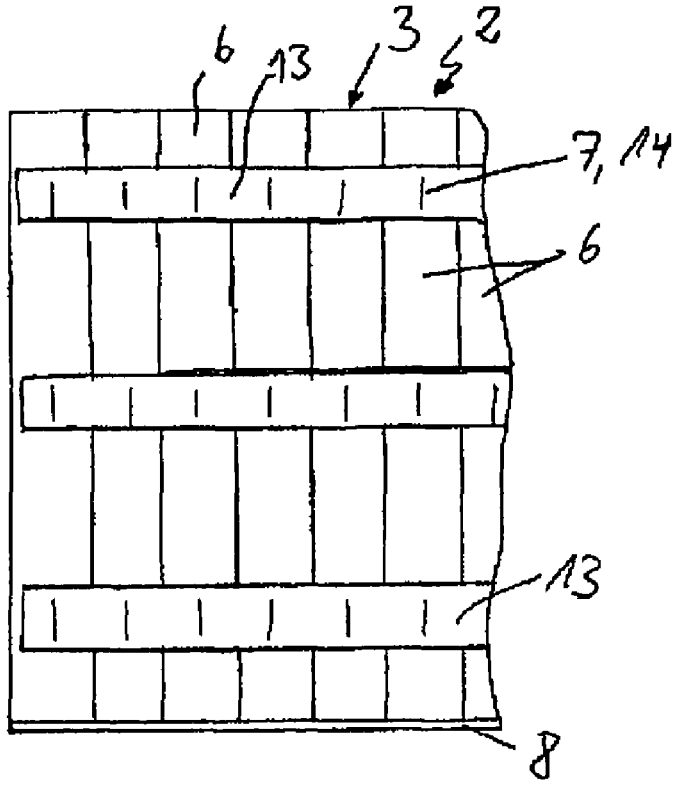
Figure 6:
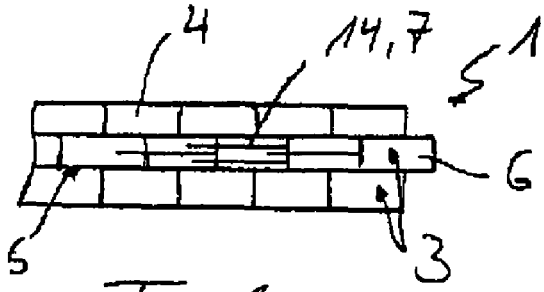
Figure 7:
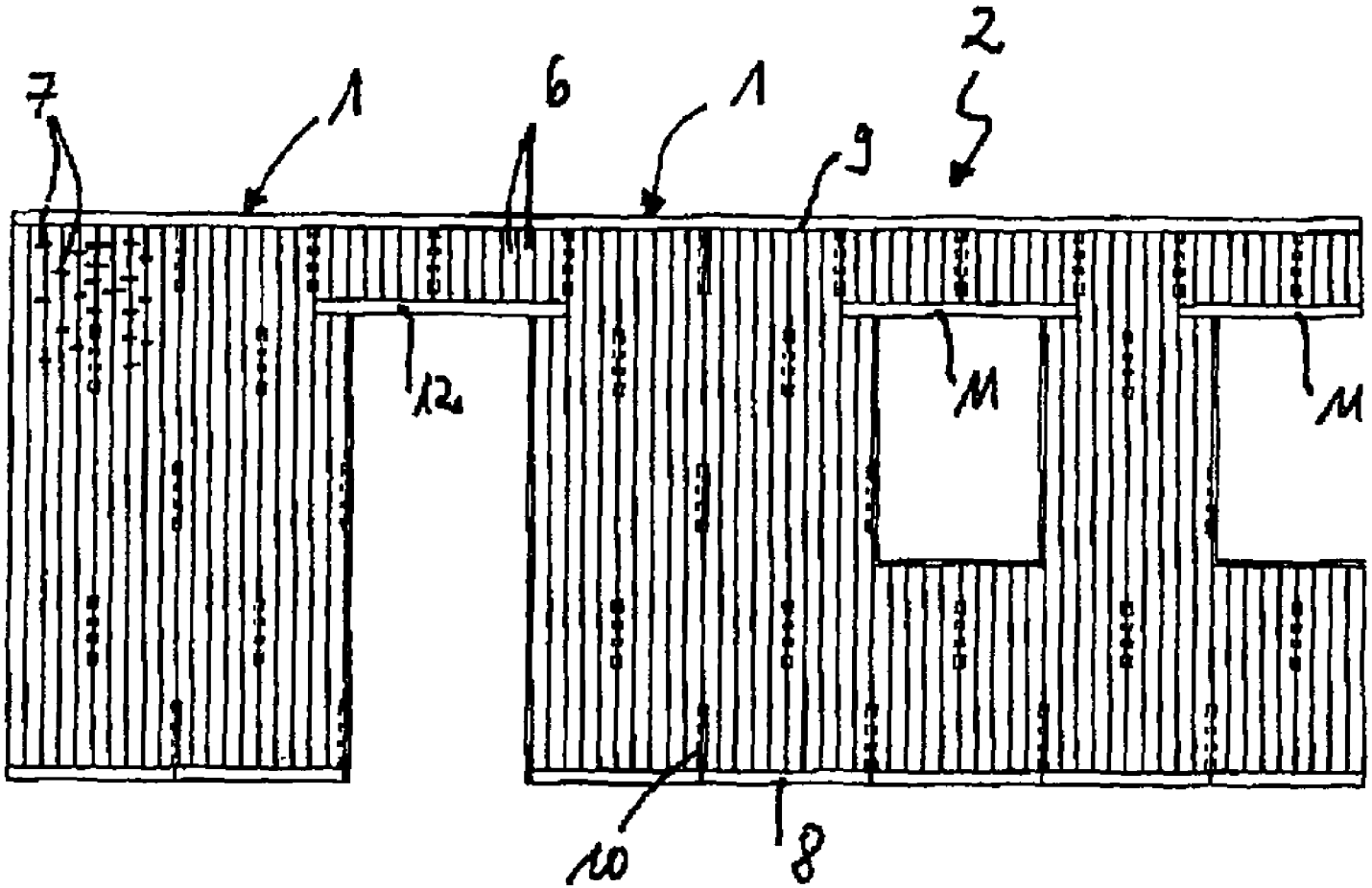
Figure 8:
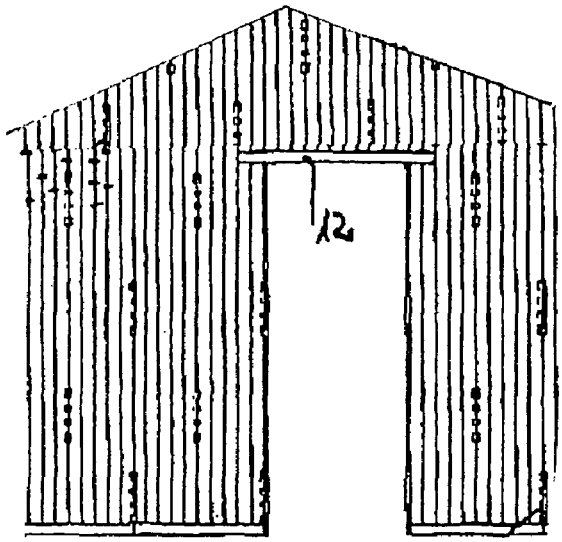
Figure 9:
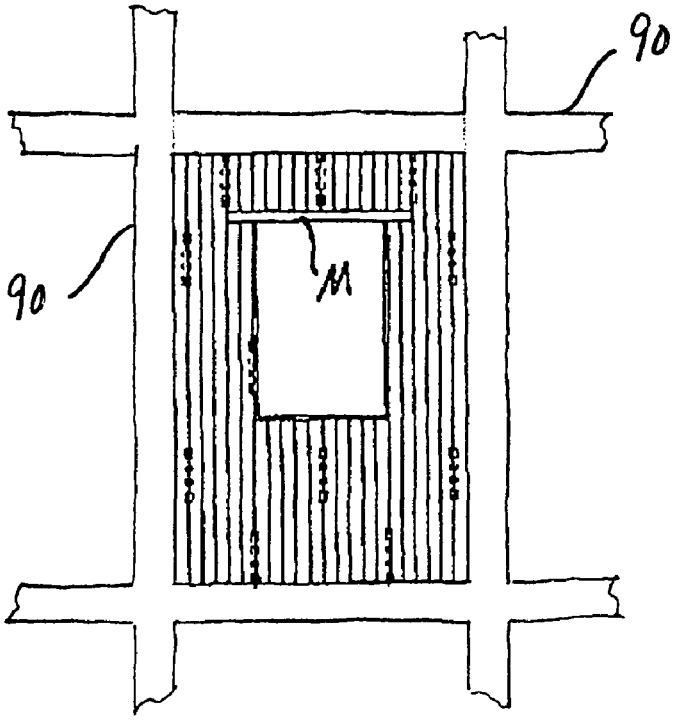

In the drawings, in each case in diagrammatic representation,

FIG. 1 shows a side view of a construction module according to the invention, FIG. 2 shows a longitudinal section in the sectional plane II-II through the construction module, FIG. 3 shows a cross section along the sectional plane through the construction module, FIG. 4 shows a cross section along the sectional plane II-II, but with a different modular structure, FIG. 5 shows a view of a wall section of the construction module from within the module core, FIG. 6 shows a cross section along the sectional plane but with a module core filled with squared timbers, FIG. 7 shows an illustrative wall having a plurality of construction modules and additional door and window openings, FIG. 8 shows an illustrative wall having a gabeled shape, and FIG. 9 shows a wall section disposed in a compartment of a framework divided by chords.

According to FIG. 1, a construction module 1 for the building of planar constructions 2 (cf. FIG. 7), in particular walls, has two parallel plate-shaped wall sections 3 and 4 (cf. FIG. 3) and an intervening module core 5. Each of the wall sections 3 and 4 comprises a plurality of room-high, solid squared timbers 6 set on end, which are connected to one another, at least non-positively, by a mechanical pinning 7 disposed transversely to the longitudinal direction of the squared timbers 6 and extending in the plane of the wall sections 3 and 4. The pinning 7, which can be realized, for example, by screws and/or dowels and/or nails and/or substantially U-shaped staples 14, connects the individual squared timbers 6 to an aforementioned wall section 3, 4 with a diaphragm-like structural effect.

Unlike the variant shown in FIG. 1, a connection of the squared timbers 6 according to the embodiment shown in FIGS. 4 and 5 is also possible. Here, each wall section 3, 4 has a plurality of room-high, solid squared timbers 6 set on end, which are respectively pinned, at least non-positively, to at least two cross-ties 13 extending transversely to the longitudinal direction of the squared timbers 6 and situated in the future module core 5. A combination of both types of connection is also, of course, conceivable. Otherwise, the pinning can also be realized by means of self-tapping screws. In the variant according to FIG. 4, also, a continuous module core 5 remains between the two wall sections 3, 4.

Preferably, the construction modules 1 have a standard height h of 260 cm, a width b of 80 cm and a thickness d of 16 cm, so that the construction modules 1 can be transported by hand and used on the construction site. In principle, however, heights of up to 500 cm and a latitudinal extent over the entire wall 2 are possible. The individual squared timbers 6 preferably have a width/thickness ratio of 2:1, for example a width of 8 cm and a thickness of 4 cm, but can also be sized differently, whereby easily adaptable widths of the construction module 1 are obtained.

The module core 5 situated between the two wall sections 3 and 4 is substantially hollow and configured to accommodate supply lines (not shown) and/or insulating materials and/or pourable bulk/liquid materials. This offers the advantage that both electric cables and water/waste water conduits can be laid within the construction module 1 and hence are not visible from outside. In addition, depending on the filling of the module core 5, a wide variety of properties, such as sound and/or heat insulation or heat storage, and different structural effects of the construction module 1 are obtainable. It is here conceivable for the module core 5, in the simplest case, to remain empty and for the air thus enclosed between the two wall sections 3 and 4 to act as an insulator. In addition, as insulators or insulating materials, other materials e.g. mineral fibers, hemp, flax, sheep's wool, cellulose, etc. may also be considered.

A filling of the module core 5 with concrete and appropriate reinforcement, or an arrangement of one or more wall sections 3, 4 within the module core 5, can considerably enhance the static structural effect of the construction module 1 and, at the same time, significantly improve the sound insulation and a heat storage capacity (cf. FIG. 6). In addition, a module core 5 of concrete or solid timber allows a fire protection wall to be formed from the construction modules 1 according to the invention. On the other hand, a filling of the module core 5 with glue accentuates a particularly ecological and durable construction and, by virtue of moisture-equalizing properties of the glue, has a particularly positive influence on the room climate. Of course, other bulk materials, e.g. gravel, sand or expanded clay, etc. are also conceivable for the filling of the module core 5.

On the floor side, the construction module 1 and/or the module core 5 is/are closed off by a single-part or multipart sill 8, whereas, on the ceiling side, i.e. on the side opposite the sill 8, there is disposed a single-part or multipart binder (wall plate) 9. A multipart, here three-part, sill is shown in FIG. 4, the sill 8 being of platform-like configuration, having a shape formed complementary to the construction module 1 and engaging in the module core 5 in the manner of a tongue. The binder 9 could also be configured in the same way, allowing the construction module 1 to rest evenly on a foundation or an above-situated ceiling to rest evenly on the construction module 1.

As shown in FIGS. 1, 2, 5 and 7, the squared timbers 6 run unjointed over the full module height h, so that visual blemishes resulting from end-face joints are able to be avoided.

In order to fix the two wall sections 3 and 4 at a parallel distance apart, spacing timbers 10 can be disposed between them, which extend substantially parallel to the squared timbers 6 and are preferably significantly shorter than these. In order to achieve an even as possible clamping effect in relation to the module core 5, the spacing timbers 10 are disposed parallel to one another and mutually offset in the longitudinal direction.

Since, in future buildings, the wall 2 can generally be formed by a plurality of mutually adjacent construction modules 1, these should easily be able to be placed one against the other in a similar manner to a building block system. For this reason, at least one of the spacing timbers 10, on one lateral longitudinal side of the wall section 3, 4, can project beyond the latter, while on the opposite longitudinal side it is set back into the module core 5, so that two mutually adjoining construction modules 1 interlock in the manner of a tongue and groove joint. When the construction modules 1 are placed one against the other, the spacing timbers 10 of the installation module 1 thus jut between the wall sections 3 and 4 into the module core 5 of the adjacent construction module 1 and, by bearing against the inner sides of the adjacent wall sections, directly form a plug joint which forms a closure under transverse force. The spacing timbers 10, which are disposed mutually offset and in parallel in the longitudinal direction, allow the module core 5 to be filled subsequently from above once the wall 2 is completed, since the bulk filling material is only negligibly prevented from spreading out in the module core 5. In this context, it is advantageously envisaged to dispose the spacing timbers 10 with their longitudinal axis inclined relative to the horizontal. The respective bulk material is thus able to fully fill the module core more easily.

According to FIG. 7, a plurality of construction modules 1 are placed side by side, a plurality of window lintels 11, extending transversely to the squared timbers 6, and a door lintel 12 being provided, which lintels extend over the full thickness d of the wall modules 1 and are hence visible from both sides. It is also conceivable, however, for the respective window and/or door lintel 11, 12 to run within the module core 5 and therefore to be invisible from outside. Irrespective of this, both the door lintel 12 and the window lintel 11 are pinned, however, to the wall sections 3 and 4.

The rectangular shape of the wall 2, as shown in FIG. 7, should here be regarded as purely illustrative, so that the formation of gabled walls or individual gables, for example above a window lintel 11 or a door lintel 12, as shown in FIG. 8, is also feasible.

Depending on the desired wall surface, the squared timbers 6 can be saw-rough, leveled or planed and thereby create a visual impression from rustic through to refined. As construction material for the construction modules 1, both soft woods, e.g. spruce, pine, larch or Douglas fir, and hard woods, can be considered. The admissible species of wood for load-bearing and stiffening construction modules 1 are listed in standards, for example in DIN 1052 and DIN 4074 or, in future, EC 5. Similarly, the pinning 7 is also determined on the basis of a standard or on the basis of building inspectorate approval and the reliable connection of the squared timbers 6 ensured. In general terms, the construction module 1 can be used for load-bearing or non-load-bearing walls, i.e. including for a utilization class 1 with constant loads.

As mentioned above, a diaphragm action of the individual wall sections 3 and 4 is obtained as a result of the pinning 7 and any vertical point loads which arise are uniformly distributed, whereby a homogenization of the load-bearing cross section can be obtained.

According to requirement, the surfaces of the wall sections 3 and 4 can be concealed, but can also be left visible on one or two sides. In this case, the wall sections 3 and 4, at least on an outer side, can conceivably be faced, in particular plastered. In a preferred embodiment, a windpaper can in this case extend between the plaster and the associated wall section 3, 4, which windpaper, though vapor-permeable, is not permeable to wind and moisture. In the case of the construction module 1 according to the invention, a vapor barrier is not necessary.

The construction module 1 according to the invention can be used for single-family and multi-family houses, via industrial and administrative buildings, through to schools, nurseries, special buildings, sports buildings and agricultural buildings, whereby a particularly broad range of use is obtained.

The embodiments shown in FIGS. 1 to 9 should here be viewed as purely illustrative, so that other embodiments too, for example having spacing timbers 10 extending transversely to the longitudinal direction of the squared timbers 6, is intended to be covered by the invention.

In order, furthermore, to arrange two construction modules 1 at an angle other than 180° to one another, either the respective longitudinal sides of the particular construction module 1 can be beveled, or else, between two construction modules 1 butting at an angle one against the other an intermediate structure is inserted, which, on the one hand, reliably fastens together the two construction modules 1 and, on the other hand, preferably ensures a continuous module core 5.

Finally, the use of the construction module 1 according to the invention in a framework is also conceivable, at least one wall section 3, 4 being able to be disposed in a compartment of the framework divided by chords 90 as shown, for example, in FIG. 9.

It is preferably envisaged to offer or stock the modules in different dimensions and, where appropriate, to produce them in accordance with the particular requirement. Advantageously, the panel-shaped wall sections can here initially be prefabricated in a chosen dimension from pinned-together squared timbers and then saw-cut to size, in accordance with the particular requirement, so as to produce tailor-made modules in virtually any chosen dimensions.

The invention claimed is:

1. A construction module for building a planar structure, said construction module comprising:

(a) first and second parallel plate-shaped wall sections;

(b) an intervening module core disposed between the wall sections; and (c) a plurality of spacing timbers disposed between the wall sections;

wherein each wall section has a plurality of solid squared timbers set on end and connected to one another by self-tapping screws disposed transversely to a longitudinal direction of the squared timbers and extending in a plane of the respective wall section, so that each wall section forms a panel;

wherein the plurality of spacing timbers are disposed parallel to one another and mutually offset in the longitudinal direction of the squared timbers;

wherein a first spacing timber of the plurality of spacing timbers is disposed at a first lateral longitudinal side of the wall sections and projects beyond the first lateral longitudinal side of the wall sections and a second spacing timber of the plurality of spacing timbers is disposed at a second lateral longitudinal side of the wall sections opposite the first lateral longitudinal side and is set back into the module core, so that the construction module can interlock with an adjacent construction module in the manner of a tongue and groove joint; and wherein said squared timbers have rectangular cross sections with a broad side of the cross section being parallel to the plane of the respective wall section.

2. The construction module as claimed in claim 1, wherein the module core is configured substantially hollow and for the reception of supply lines and/or insulating materials and/or pourable bulk/liquid materials.

3. The construction module as claimed in claim 1, further comprising at least a third wall section within the module core.

4. The construction module as claimed in claim 3, wherein the third wall section disposed in the module core, on a first lateral longitudinal side of the first wall section, projects beyond the first lateral longitudinal side, while on a second opposite longitudinal side the third wall section is set back into the module core, for interlocking with an adjoining construction module in a manner of a tongue and groove joint.

5. The construction module as claimed in claim 1, wherein the construction module is configured as a fire protection module.

6. The construction module as claimed in claim 1, wherein at least one of the construction module and the module core is closed off on the floor side by a single-part or multipart sill, and/or at least one of the construction module and the module core is closed off on the ceiling side by a single-part or multipart binder.

7. The construction module as claimed in claim 6, wherein the sill and/or the binder are configured complementary to the construction module and engage in the module core in the manner of a tongue.

8. The construction module as claimed in claim 1, wherein the squared timbers run unjointed over the height of the module.

9. The construction module as claimed in claim 1, wherein the spacing timbers are disposed with their longitudinal axis inclined relative to the horizontal.

10. The construction module as claimed in claim 1, wherein in the construction module there is provided a door or window lintel, extending transversely to the squared timbers, which runs in the module core and is pinned to the wall sections.

11. The construction module as claimed in claim 1, wherein the construction modules standardly have a height of 260 cm, a width of 80 cm and a thickness of up to 16 cm, the squared timbers standardly have a width of 8 cm and a thickness of 4 cm.

12. The construction module as claimed in claim 1, wherein the squared timbers are saw-rough, leveled or planed.

13. The construction module as claimed in claim 1, wherein the construction module is produced from soft and/or hard woods.

14. The construction module as claimed in claim 1, wherein the wall sections, at least on an outer side, are faced, in particular plastered.

15. The construction module as claimed in claim 1, wherein the wall sections have a gabled shape.

16. The construction module as claimed in claim 1, wherein at least one wall section is disposed in a compartment of a framework divided by chords.

17. The construction module as claimed in claim 1, wherein the squared timbers are connected or pinned to one another to form large, panel-shaped wall sections and are subsequently cut to predefinable measurements, and wherein the cuts are combined to form double-walled or multi-walled modules of predefined dimensions with spacing timbers disposed between every two wall sections in module cores.

18. A construction module according to claim 1, further comprising at least one of an insulating material and a pourable bulk/liquid material received within the module core, said pourable bulk/liquid material being selected from the group consisting of concrete, glue, sand, gravel, grit, expanded clay, and bulk insulating materials, said insulating material being selected from the group consisting of air, mineral fibers, hemp, flax, wool, and cellulose.

* * * * *